US005386667A

United States Patent [19]

Häusslein et al.

[11] Patent Number: 5,386,667

[45] Date of Patent: Feb. 7, 1995

[54] PORTABLE MACHINE TOOL

[75] Inventors: Friedrich Häusslein, Leinfelden-Echterdingen; Peter Röhrup, Ulbersdorf; Egbert Steinbrück, Sebnitz, all of Germany

[73] Assignee: Robert Bosch GmbH, Stuttgart, Germany

[21] Appl. No.: 137,179

[22] PCT Filed: Apr. 24, 1992

[86] PCT No.: PCT/DE92/00332

§ 371 Date: Oct. 21, 1993

§ 102(e) Date: Oct. 21, 1993

[87] PCT Pub. No.: WO92/19423

PCT Pub. Date: Nov. 12, 1992

[30] Foreign Application Priority Data

Apr. 26, 1991 [DE] Germany ..... 4113641

[51] Int. Cl.[6] ..... B24B 23/00

[52] U.S. Cl. ..... 451/344; 451/360; 451/451

[58] Field of Search ..... 51/268, 170 R, 170 PT, 51/269, 271, 272; 30/390, 391

[56] References Cited

U.S. PATENT DOCUMENTS

| | | | |
|---|---|---|---|
| 1,638,459 | 8/1927 | Ritz | 51/268 |
| 4,059,930 | 11/1977 | Alessio | 51/268 |
| 4,574,532 | 3/1986 | Häberle et al. | 51/268 |
| 5,005,321 | 4/1991 | Barth et al. | 51/268 |
| 5,031,325 | 7/1991 | Walter et al. | 51/268 |

FOREIGN PATENT DOCUMENTS

| | | | |
|---|---|---|---|
| 3633943 | 4/1988 | Germany . | |
| 3636500 | 4/1988 | Germany | 51/268 |
| 3638337 | 5/1988 | Germany | 51/268 |
| 3744219 | 7/1989 | Germany . | |
| 0390367 | 8/1990 | Germany | 51/170 R |
| 3913898 | 10/1990 | Germany . | |
| 3919649 | 12/1990 | Germany | 51/170 R |
| 3940584 | 6/1991 | Germany | 51/268 |

*Primary Examiner*—Bruce M. Kisliuk
*Assistant Examiner*—Derris H. Banks
*Attorney, Agent, or Firm*—Michael J. Striker

[57] ABSTRACT

A portable machine tool comprises a drive spindle provided with a tool receiver, a bearing flange which mounts the drive spindle and has a clamping neck, a protective hood which at least partially covers a tool and is held securely against rotation on the clamping neck, and elements for connecting the protective hood and the clamping neck, the connecting elements including a sleeve-shaped plug-on collar provided on the protective hood and having radial projections, an annular groove provided in the clamping neck so that radial projections can engage in the annular groove, and also axial grooves provided in the clamping neck and extending from a free end face of the clamping neck into the annular groove, the axial grooves being arranged and formed so that the radial projections of the plug-on collar can pass through the axial grooves in a plugging-on position which is turned relative to a position of use of the protective hood.

18 Claims, 3 Drawing Sheets

PORTABLE MACHINE TOOL

BACKGROUND OF THE INVENTION

The present invention relates to a portable machine tool, in particular an angle-grinding machine.

More particularly, it relates to a portable machine tool which has a drive spindle bearing a tool receiver and mounted in a bearing flange with a clamping neck, and a protective hood which at least partially covers the tool and is held securely against rotation on the clamping neck.

In a known portable machine tool of this type (DE 3,744,219 A1), the protective hood fitted with a passage opening onto the clamping neck is held so as to be axially non-displaceable between two retaining rings which are secured by a spring ring which is inserted in an annular groove worked into the clamping neck. For securing the protective hood against rotation, a lever is fastened non-rotatably on the clamping neck, which lever engages with a nose in a positive-locking manner in bores or grooves in the protective hood. By lifting the nose out of the respective bore, the protective hood can be rotated about the axis of the clamping neck into a desired position. After release of the lever, the nose engages in a further bore or groove, and the protective hood is fixed in this new rotary position.

SUMMARY OF THE INVENTION

Accordingly, it is an object of the present invention to provide a portable machine tool, which avoids the disadvantages of the prior art.

In keeping with these objects and with others which will become apparent hereinafter, one feature of the present invention resides, briefly stated, in a portable machine tool in which the protective hood bears a sleeve-shaped plug-on collar which is pushed on the clamping neck and engages with radial projections in an annular groove in the clamping neck, and the axial grooves are provided in the clamping neck and start from the free end face, open out into the annular groove and arranged and constructed so that they allow passage of the radial projections 18 in a plug-on position which is rotated relative to the position of use of the protective hood.

When the portable machine tool is designed in accordance with the present invention, it has the advantage that the protective hood can be removed from the portable machine tool and connected to the latter again without the use of an assistant tool. The handling required for this purpose can be carried out in a simple and time-saving manner. After release of the locking device, the protective hood only needs to be rotated into its plug-on position and can then be removed axially from the clamping neck. The connection operation of the protective hood with the portable machine tool takes place in the reverse direction. The connection of the protective hood to the portable machine tool is constructionally considerably simpler and requires far fewer individual parts. In total, the protective hood with a connecting element to the portable machine tool can be produced more cost-effectively, is smaller in construction and lighter and leads, in total, to a lower weight of the portable machine tool.

According to a preferred exemplary embodiment of the invention, a spring element which is sprung in the axial direction is held securely against rotation on the clamping neck, which spring element is supported, on the one hand, on the bearing flange of the portable machine tool and, on the other hand, on the end face of the plug-on collar facing away from the protective hood. The one locking member of the locking device is constructed on the spring element, specifically as a locking nose projecting axially away from the spring element, and the corresponding locking member is formed by at least one recess which is arranged in the end face of the plug-on collar facing the spring element and into which the locking-nose protrudes in a positive-locking manner. By means of these constructional measures, the manual locking device can be implemented in a very simple and cost-effective manner. If a plurality of equidistantly arranged recesses are provided, which are distributed over part of the circumference of the plug-on collar, the protective hood can be fixed non-rotatably in each case in different pivoted positions.

In a further embodiment of the invention, a catch nose is constructed on the spring element and, arranged equidistantly in the end of the plug-on collar facing the spring element, there are catch depressions which interact with the catch nose and are distributed over part of the circumference of the plug-on collar. In this case, the locking nose and the catch nose are preferably arranged diametrically opposite one another on the spring element, and the arrangement of the recesses and catch depressions is designed such that, when the catch nose engages in a catch depression, the locking nose is flush with one of the recesses in each case. The spring element thus additionally has a kind of ratchet function, as a result of which the protective hood can only be rotated by fixed angular steps. For each angular step, it is ensured that the locking nose can drop into one of the recesses.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
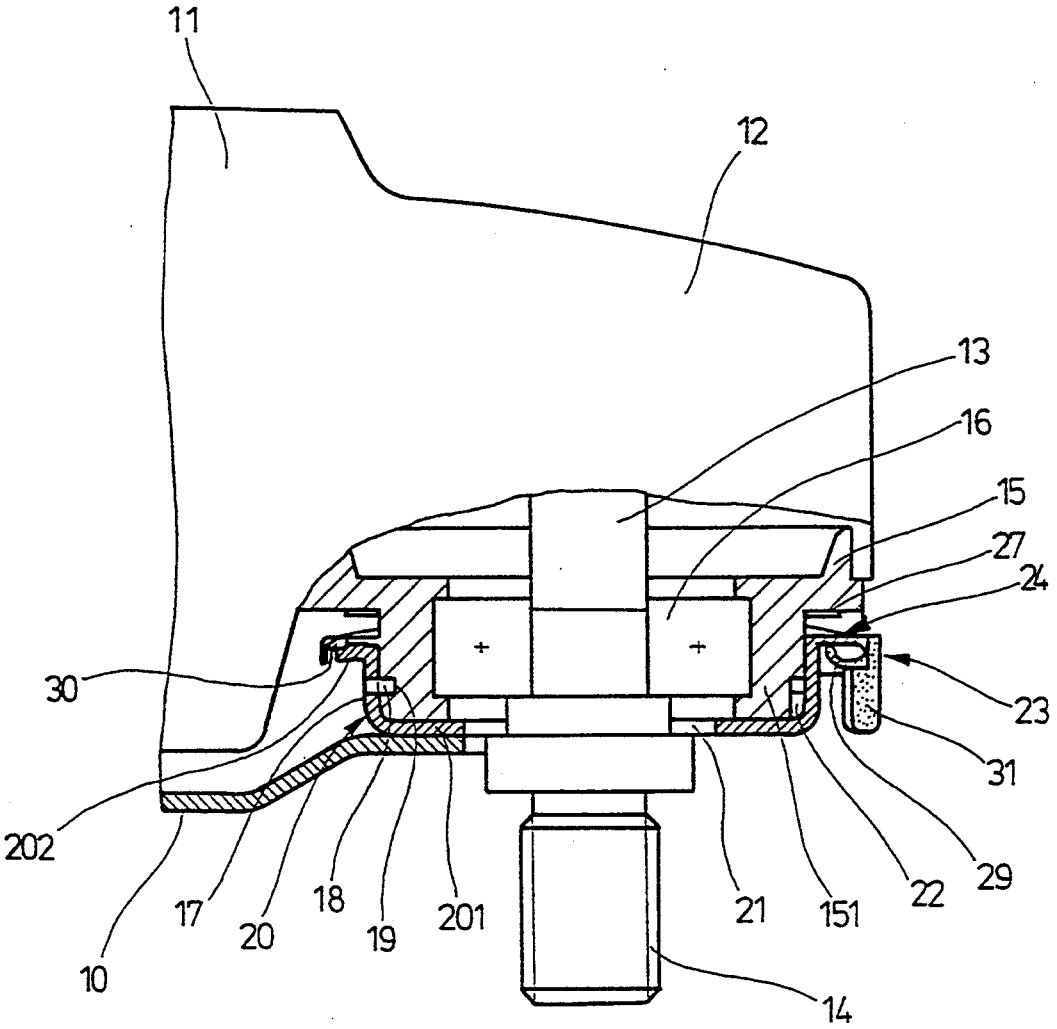
FIG. 1 shows an extract in a lateral view of an angle-grinding machine with a protective hood, partially cut away.

Of the hand-held angle-grinding machine with a protective hood 10, illustrated as an extract in FIG. 1 as an example of a general portable machine tool, the motor housing 11 and the gear housing 12 can be seen. Protruding out of the gear housing 12 is a drive spindle 13 which bears at its free end a receiver 14 for a grinding or cutting-off wheel (not illustrated here). The drive spindle 13 is mounted in a bearing flange 15 which is fastened in the gear housing 12, preferably by means of threaded screws, and projects out of the gear housing 12 with a clamping neck 151 which is reduced in diameter. A radial bearing 16 for the drive spindle 13 is received in the clamping neck 151, and the protective hood 10, which covers half the grinding or cutting-off wheel, is fastened on the outside of the clamping neck 151.

Figure 2:
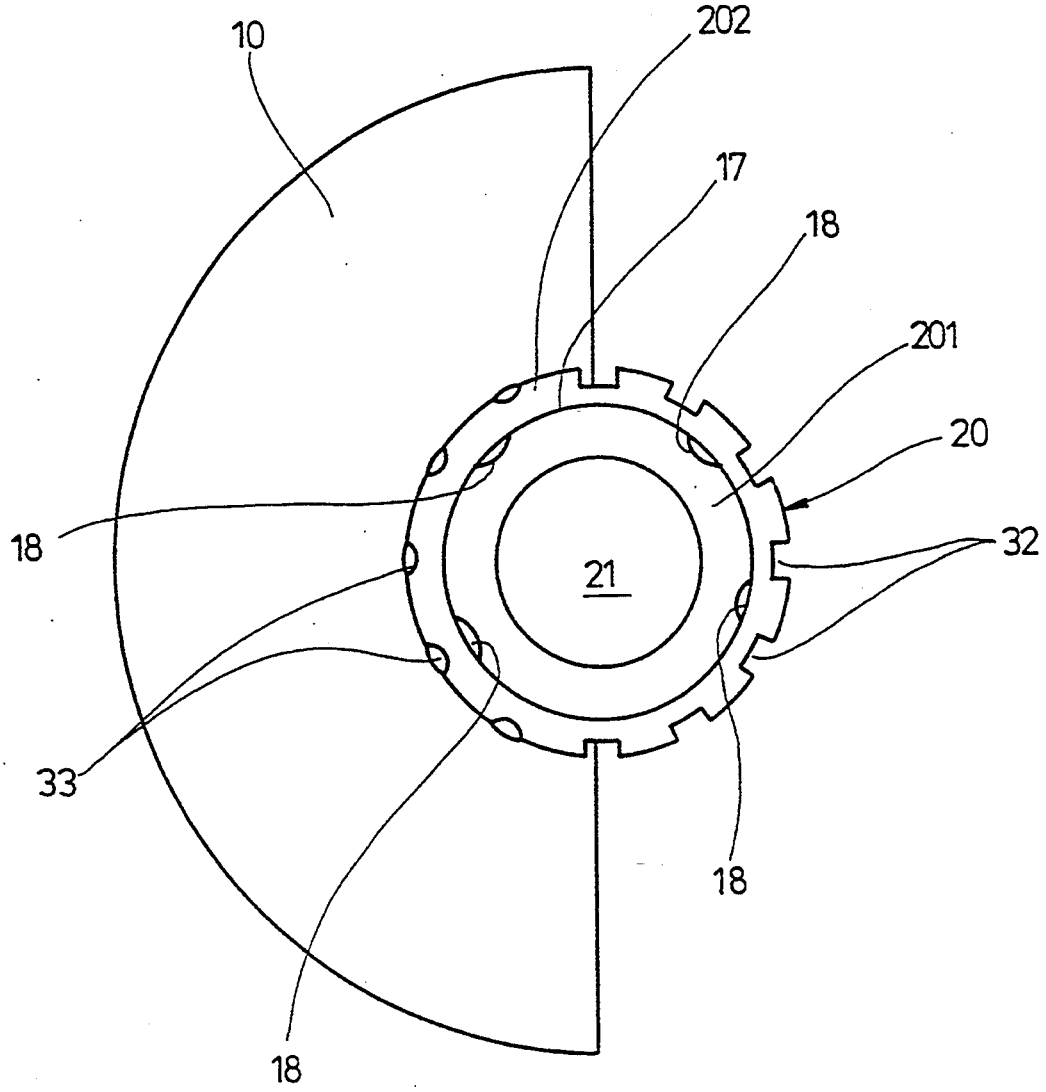
FIG. 2 shows a plan view of the protective hood for the angle-grinding machine in FIG. 1.

For this purpose, the protective hood 10 bears a sleeve-shaped plug-on collar 17 which is pushed onto the clamping neck 151 and engages with radial projections 18, projecting away from the inner wall, into an annular groove 19 constructed in the clamping neck 151. The plug-on collar 17 is-formed by the central part of a bell-shaped sheet-metal cap 20 which bears a coaxial opening 21 in the cap bottom 201 for the passage of the drive spindle 13 with the receiver 14, and is connected non-releasably, e.g. by welding, to the protective hood 10. Provided on the clamping neck for pushing on the plug-on collar 17 of the sheet-metal cap 20 are axial grooves 22 which open out, on the one hand, in the annular groove 19 and end freely, on the other hand, at the end face of the clamping neck 151. The width of the axial grooves 22 is selected such that the radial projections 18 on the plug-on collar 17 can slide in the axial grooves 22. The number of axial grooves 22 corresponds to the number of radial projections 18, there being in this case a total of four radial projections 18 produced by sheet-metal embossings, as can be seen in FIG. 2. The spacing of the axial grooves 22 from one another, seen in the circumferential direction, corresponds precisely to the spacing of the respective radial projections 18, such that, when the plug-on collar 17 is fitted onto the clamping neck 151, a radial projection 18 can be inserted in each case in an axial groove 22 and can be displaced axially therein. In this case, the arrangement of the axial grooves 22 on the clamping neck 151 is designed such that the fitting-on of the plug-on collar 17 can take place only in one rotary position of the protective hood 10 which does not correspond to the position or positions of use of the protective hood 10. When the plug-on collar 17 has been pushed in to the extent that the radial projections 18 are inserted in the annular groove 19, by turning the protective hood 10 with the sheet-metal cap 20, the protective hood 10 departs from this position of non-use, in which case the radial projections 18 slide in the annular groove 19.

Figure 3:
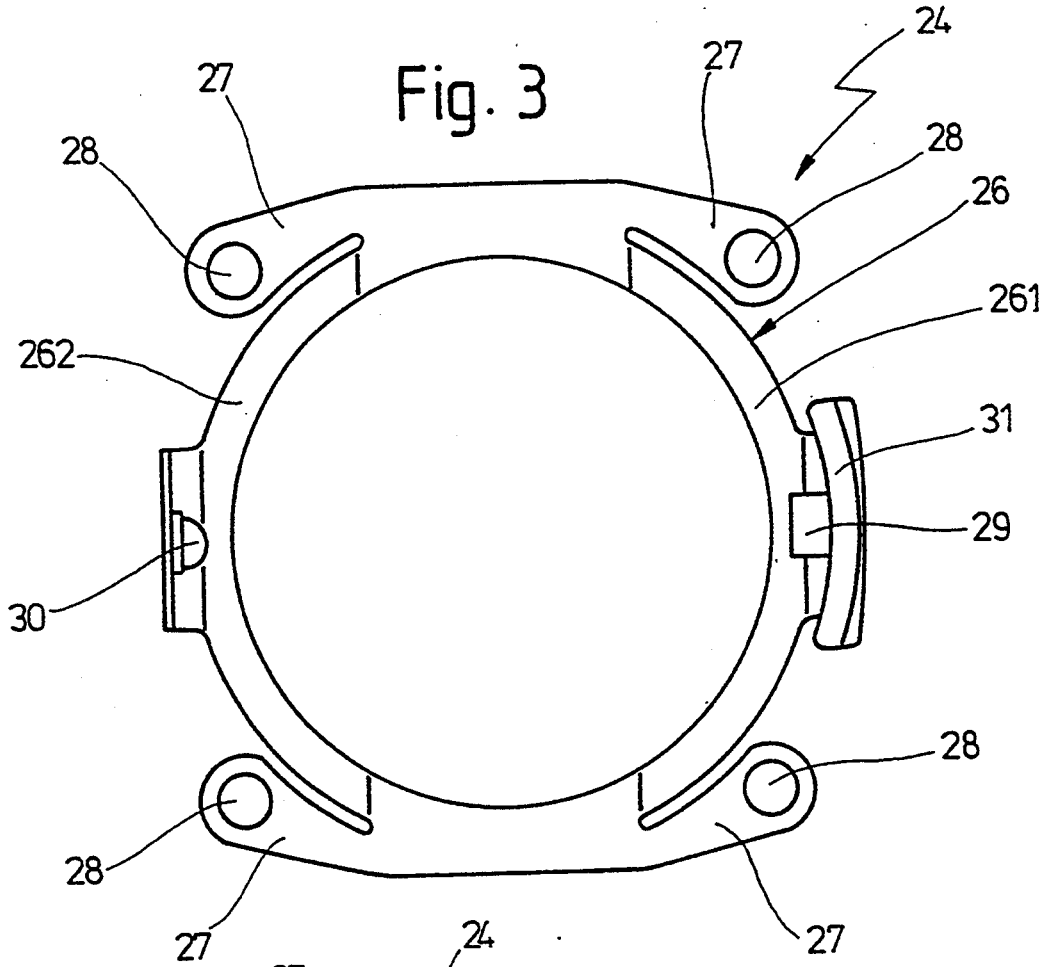
FIG. 3 shows a plan view of a spring element, held on the bearing flange, of the angle-grinding machine in FIG. 1.
Figure 4:
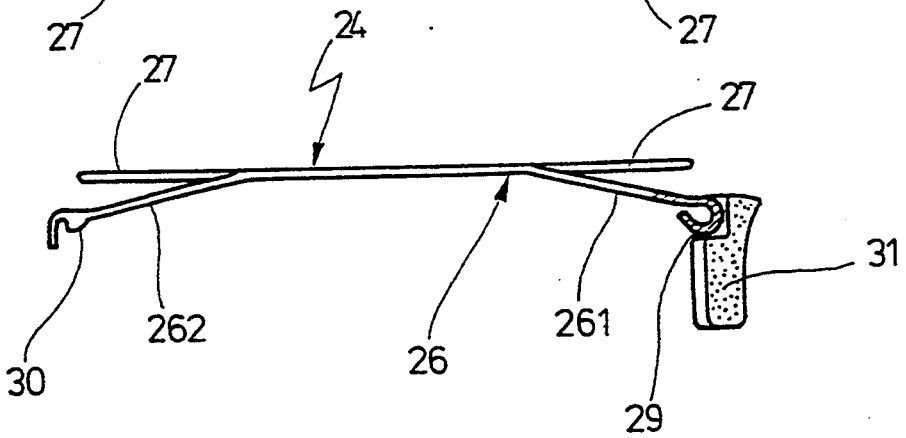
FIG. 4 shows a front view of the spring element in FIG. 3.

To fix the protective hood 10 in at least one desired position relative to the clamping neck 151, a manually actuable locking device 23 is provided. It has a spring element 24 which is fastened non-rotatably on the bearing flange 15. The spring element 24 is illustrated in detail in FIGS. 3 and 4. It is punched out of spring steel and has a ring 26 which, as can be seen clearly in FIG. 4, is bent down out of the punching plane on diametrically opposite sides. Connected integrally to the ring 26 are four fastening tabs 27 which lie in the plane of the spring element 24 and bear in each case a passage opening 28 for a fastening screw. With these fastening tabs 27, the spring element 24 rests on the bearing flange 15, the ring 26 surrounding the clamping neck 151 with radial spacing. The threaded screws with which the bearing flange 15 is fastened on the gear housing 121are used for fastening on the bearing flange 15, such that the fastening tabs 27 form a kind of washer for these threaded screws. Arranged on the bent-down halves 261, 262 of the ring on the underside facing away from the fastening tabs 27 are, on the one hand, a locking nose 29 projecting downwards and, on the other hand, a catch nose 30 embossed downwards. Moulded directly onto the locking nose 29 on the half 261 of the ring there is also an actuating key 31 which, when the protective hood 10 has been fitted on, extends axially over the plug-on collar 17 up to the cap bottom 201 of the actuating cap 20.

The sheet,metal cap 20 bears at its end a radially outwardly projecting rim 202 in which equidistant recesses 32 are punched approximately over half its circumference (cf. FIG. 2). The width of the recesses 32 corresponds to the width of the locking nose 29 such that the latter is able to engage in a positive-locking manner in the recesses 32 in the circumferential direction. Equidistant, bead-like catch depressions 33 are impressed over the other half of the circumference of the rim 202. The spacing of the catch depressions 33 from one another corresponds to the spacing of the recesses 32 from one another, the catch depressions 33 being located, due to the diametric arrangement of the locking nose 29 and the catch nose 30, in such a way that in each case a catch depression 33 is located diametrically opposite a recess 32. The catch nose 30 engages in the catch depressions 33 under spring pressure such that a kind of ratchet is produced, by means of which, when the locking nose 29 has been lifted out of the assigned recess 32, the protective hood 10 can be pivoted through an angle of rotation predetermined by the arrangement of the catch depressions 33.

The protective hood 10 described, with the plug-on collar 17 fastened thereon, can be attached to the angle-grinding machine or removed from the latter again without the use of an assistant tool. For pushing-on, the protective hood 10 is to be attached to the clamping neck 151 in such a rotary position that the radial projections 18 in the plug-on collar 17 are flush with the axial grooves 22 in the clamping neck 151. The plug-on collar 17 is then pulled axially onto the clamping neck 151 until the radial projections 18 come to rest in the annular groove 19 in the clamping neck 151. During the final part of the displacement path, the rim 202 of the plug-on collar 17 or of the sheet-metal cap 20 rests against the two halves 261, 262 of the ring of the spring element 24 and displaces them in the axial direction, as a result of which the spring element 24 supported between the bearing flange 15 and the sheet-metal cap 20 receives a prestress. When the actuating key 31 of the locking device 23 has been pushed up, the protective hood 10 can be rotated about the clamping neck 151 until it assumes the desired position. The catch nose 30 which slides into and out of the catch depression 33 during this process determines defined positions of the protective hood 10. If, in such a position, the actuating key 31 is released, the locking nose 29 is pushed by spring force into the respective recess 32. The plug-on collar 17 and thus the protective hood 10 are fixed non-rotatably on the clamping neck 151.

To remove the clamping hood 10, after lifting the actuating key 31 and the unlocking device, connected thereto, of the protective hood 10, the latter is to be rotated on the clamping neck 151 until the radial projections 18 inside the annular groove 19 are flush with the axial grooves 22. In this position, the protective hood 10 can be removed axially from the clamping neck 151.

The invention is not restricted to the exemplary embodiment described above. For instance, the actuating key 31 can be injection-moulded as a plastic part onto the .spring element 24 made of spring band steel. However, the entire spring element 24 can also be designed as a plastic part which is either fastened on the bearing flange 15, as described, or is moulded integrally onto the bearing flange which is likewise made of plastic. In the latter case, the fastening tabs 27 are omitted.

Furthermore, the invention is not restricted to the connection of a protective hood to an angle-grinding machine. For instance, in the manner according to the invention, a handle can also be connected to a drilling machine, for example, in which case all the constructional measures described and undertaken on the protective hood are to be implemented on the handle. The invention can consequently also be applied wherever additional handles on portable machine tools are to be rotated and/or adjusted in an angular manner, but also wherever clamping chucks of portable machine tools are to be rotated in such a way.

It will be understood that each of the elements described above, or two or more together, may also find a useful application in other types of constructions differing from the types described above.

While the invention has been illustrated and described as embodied in a portable machine tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A portable machine tool, comprising a drive spindle provided with a tool receiver; a bearing flange which mounts said drive spindle and has a clamping neck; a protective hood which at least partially covers a tool and is held securely against rotation on said clamping neck; and means for connecting said protective hood and said clamping neck, said connecting means including a sleeve-shaped plug-on collar provided on said protective hood and having radial projections, an annular groove provided in said clamping neck so that radial projections can engage in said annular groove, and also axial grooves provided in said clamping neck and extending from a free end face of said clamping neck into said annular groove, said axial grooves being arranged and formed so that said radial projections of said plug-on collar can pass through said axial grooves in a plugging-on position which is turned relative to a position of use of said protective hood.

2. A portable machine tool as defined in claim 1; and further comprising a spring element which is sprung in an axial direction and held securely against rotation on said clamping neck, said spring element having one end supported on said bearing flange and another end supported on an end face of said plug-on collar facing away from said protective hood; and further comprising means for locking said protective hood in at least one position, said locking means including one locking member formed on said spring element and another locking member formed on said plug-on collar.

3. A portable machine tool as defined in claim 2, wherein said one locking member is formed as a locking nose projecting axially away from said spring element, said another locking member being formed as at least one recess arranged in the end face of said plug-on collar facing said spring element and receiving said locking nose in a positive-locking manner.

4. A portable machine tool as defined in claim 3, wherein said another locking member is formed by a plurality of such recesses which are distributed over only one part of the circumference of said plug-on collar.

5. A portable machine tool as defined in claim 4, wherein said recess are arranged equidistantly relative to one another.

6. A portable machine tool as defined in claim 3; and further comprising an actuating key arranged on said spring element for lifting said locking nose out of said recess.

7. A portable machine tool as defined in claim 6, wherein said actuating key is mounted near to said locking nose and extends parallel to said clamping neck away from said spring element.

8. A portable machine tool as defined in claim 3; and further comprising a catch nose provided on said spring element, and a plurality of catch depressions arranged in an end of said plug-on collar facing said spring element, said catch depressions interacting with said catch nose and being distributed over only a part of the circumference of said plug-on collar.

9. A portable machine tool as defined in claim 8, wherein said catch depressions are arranged equidistantly relative to one another.

10. A portable machine tool as defined in claim 8, wherein said locking nose and said catch nose are arranged diametrically opposite one another on said spring element, said recesses and said catch depressions being arranged so that when said catch nose engages in said catch depression, one of said recesses is flush with said locking nose.

11. A portable machine tool as defined in claim 8, wherein said spring element has a ring composed of sprung material and surrounding said clamping neck with radial spacing, said ring being provided with tabs molded integrally onto said ring for fastening to said bearing flange, said nose and said catch nose projecting axially away from an annular surface of said ring, said ring having two halves which carry said locking nose and said catch nose and are bent down out of a plane of said fastening tabs.

12. A portable machine tool as defined in claim 11, wherein said ring is composed of spring bent steel.

13. A portable machine tool as defined in claim 11; and further comprising a machine housing, said fastening tabs each having a passage opening for a fastening screw which serves for fastening said bearing flange on said machine housing.

14. A portable machine tool as defined in claim 13, wherein there are four of said fastening tabs.

15. A portable machine tool as defined in claim 2, wherein said spring element is formed integrally with said bearing flange.

16. A portable machine tool as defined in claim 1, wherein said plug-on collar is composed of sheet metal, said radial projections being formed by sheet-metal embossings.

17. A portable machine tool as defined in claim 1, wherein said plug-on collar is formed as a plastic part injection molded on said protective hood.

18. A portable machine tool as defined in claim 1; and further comprising a bell-shaped cap having a cap bottom provided with a coaxial opening for passing said drive spindle with said tool receiver, said plug-on collar being formed as a part of said bell-shaped cap, said protective hood being fastened non-releasably on said cap bottom.

* * * * *